US006252213B1

(12) United States Patent
Kang

(10) Patent No.: US 6,252,213 B1
(45) Date of Patent: Jun. 26, 2001

(54) METHOD AND APPARATUS FOR COMPENSATING COOKING TIME OF MICROWAVE OVEN

(75) Inventor: Dae Byung Kang, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/597,238

(22) Filed: Jun. 20, 2000

(30) Foreign Application Priority Data

Jun. 25, 1999 (KR) ..... 99-24348

(51) Int. Cl.[7] ..... H05B 6/68

(52) U.S. Cl. ..... 219/702; 219/704; 219/715; 219/719; 99/325

(58) Field of Search ..... 219/702, 704, 219/719, 715, 716, 721, 490, 497; 99/DIG. 14, 325, 451; 323/299

(56) References Cited

U.S. PATENT DOCUMENTS

| | | | | |
|---|---|---|---|---|
| 5,317,133 | * | 5/1994 | Sundstrom et al. | 219/719 |
| 5,498,858 | * | 3/1996 | Jeong | 219/702 |
| 5,506,390 | * | 4/1996 | Seo | 219/716 |
| 6,066,839 | * | 5/2000 | Park | 219/719 |

* cited by examiner

*Primary Examiner*—Philip H. Leung
(74) *Attorney, Agent, or Firm*—Fleshner & Kim, LLP

(57) ABSTRACT

A method for compensating cooking time of a microwave oven which sets an exact reference voltage and automatically controls cooking time in accordance with variation of an input voltage, includes the steps of: setting the reference voltage based on the input voltage regulated to a rated voltage in a state that power is applied or a load is driven and storing the reference voltage in a memory; checking a level of a currently input voltage; and calculating compensating time in accordance with a difference value between the currently input voltage and the reference voltage. Thus, it is possible to minimize dissatisfaction of a user due to voltage variation.

13 Claims, 2 Drawing Sheets

METHOD AND APPARATUS FOR COMPENSATING COOKING TIME OF MICROWAVE OVEN

BACKGROUND OF THE INVENTION

1. Field of the Invention

The present invention relates to a microwave oven, and more particularly, to a method and apparatus for compensating cooking time of a microwave oven.

2. Description of the Related Art

A related art apparatus for compensating cooking time of a microwave oven will be described with reference to FIG. 1.

As shown in FIG. 1, the related art apparatus for compensating cooking time of a microwave oven includes an input power part 1, a voltage dividing resistor 2, a regulated power circuit part 3, a data input part 6, a controller 4, a load driver 7, and a display part 5. The input power part 1 converts commercial power to a predetermined operation voltage. The voltage dividing resistor 2 divides the operation voltage from the input power part 1. The regulated power circuit part 3 uniformly maintains the operation voltage. A user selects a desired mode through the data input part 6. The controller 4 controls cooking time in accordance with the mode selected by the data input part 6. That is to say, the controller 4 receives the divided voltage from the voltage dividing resistor 2 to sense its voltage level and compensate cooking time, and outputs a corresponding control signal. The load driver 7 drives a load in accordance with the control signal. The display part 5 displays the operation state in accordance with the mode selected by the data input part 6.

The operation of the related art apparatus for compensating cooking time of a microwave oven will be described.

The input power part 1 converts the commercial power to a predetermined operation voltage, i.e., low voltage. The voltage dividing resistor 2 includes a plurality of resistors R1 and R2 connected in parallel at both ports of the input power part 1 to divide the operation voltage. The regulated power circuit part 3 uniformly maintains the operation voltage to be applied as the driving power of the controller 4.

If a user selects a menu through the data input part 6, the controller 4 controls the load driver 7 in accordance with the selected menu to proceed with a cooking mode. At this time, the controller 4 receives the voltage divided by the resistors R1 and R2 through an A/D port to sense its level. Then, the controller 4 compares the sensed voltage level with a given reference voltage to compensate cooking time. The reference voltage means a voltage of which certain value is equally applied to microwave ovens without considering voltage variation at an output port of the input power part and deviation of the resistors.

However, the aforementioned related art apparatus for compensating cooking time of a microwave oven has several problems.

First, it is difficult to exactly determine actual voltage variation of input voltage variation due to voltage variation at the output port of the input power part and deviation of the resistors.

Despite errors occurred in the A/D port due to deviation of the resistors, the voltage of the A/D port is compared with the reference voltage commonly given to the products. This makes exact data difficult to sense.

Finally, cooking time is compensated by erroneously calculating due to errors generated by deviation of the resistors, thereby reducing cooking reliability.

SUMMARY OF THE INVENTION

Accordingly, the present invention is directed to an apparatus and method for compensating cooking time of a microwave oven, that substantially obviates one or more of the problems due to limitations and disadvantages of the related art.

An object of the present invention is to provide an apparatus and method for compensating cooking time of a microwave oven, in which an input voltage applied when cooking begins, so that cooking time can be compensated in accordance with variation of the input voltage.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for compensating cooking time of a microwave oven according to the present invention includes: an input power part for converting a commercial power to a predetermined operation voltage; a voltage dividing resistor for dividing the operation voltage; a memory for setting a voltage of an A/D port as a reference voltage after the input voltage is intentionally regulated to a rated voltage in a state that power is applied or a load is driven, and storing the reference voltage; and a controller for comparing the reference voltage stored in the memory with the operation voltage divided by the voltage dividing resistor and currently applied, to compensate cooking time in accordance with a difference value between them.

In another aspect, a method for compensating cooking time of a microwave oven having a memory includes the steps of setting a reference voltage based on a rated voltage regulated in a state that power is applied or a load is driven and storing the reference voltage in the memory, checking a currently input voltage value, and calculating cooking time in accordance with a difference between the currently input voltage and the reference voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An apparatus for compensating cooking time of a microwave oven according to the present invention will be described with reference to FIG. 2.

Figure 1:
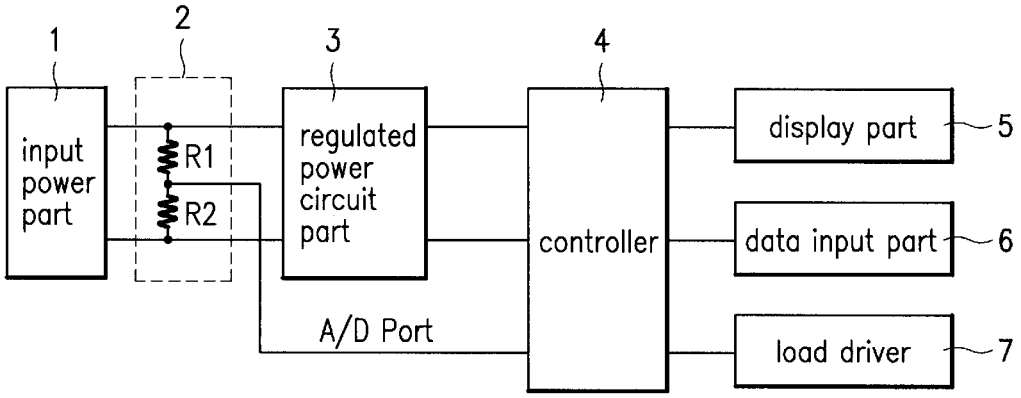
FIG.1 Related Art
FIG. 1 is a block diagram showing a related art apparatus for compensating cooking time of a microwave oven.
Figure 2:
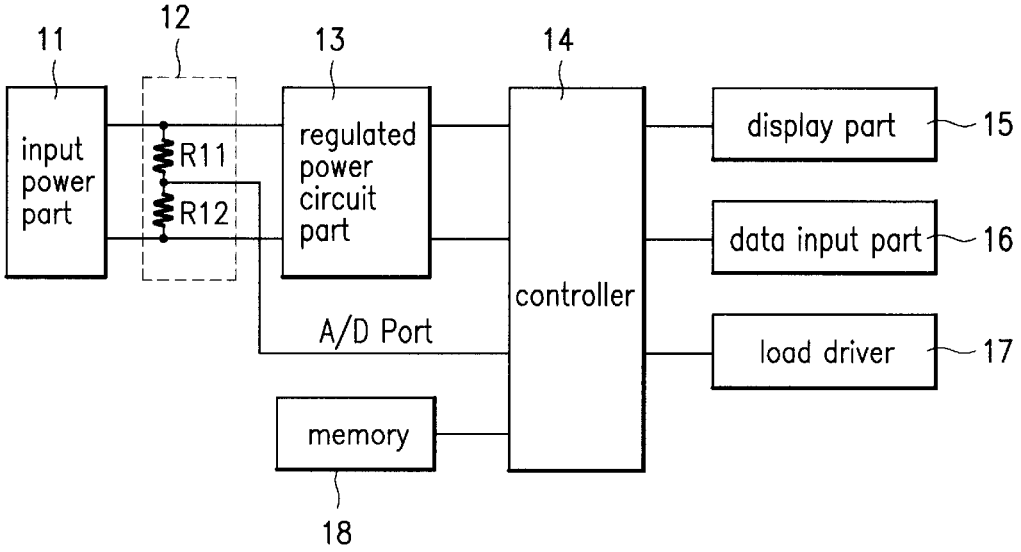
FIG. 2 is a block diagram showing an apparatus for compensating cooking time of a microwave oven according to the present invention.

As shown in FIG. 2, the apparatus for compensating cooking time of a microwave oven according to the present invention includes an input power part 11 for converting a commercial power to a predetermined operation voltage, a voltage dividing resistor 12 for dividing the operation voltage, a regulated power circuit part 13 for uniformly maintaining the operation voltage, a memory 18 for storing a voltage output from the voltage dividing resistor 12 as a reference voltage after regulating the input voltage to a rated voltage in a state that power is applied or a load is driven, a data input part 16 for selecting a user's desired menu, a controller 14 driven by the operation voltage output from the regulated power circuit part 13, for controlling cooking mode in accordance with a menu selected by the data input part 16 and comparing the operation voltage divided by the voltage dividing resistor 12 with the reference voltage stored in the memory 18 to output a control signal for compensating cooking time, a load driver 17 for driving a load in accordance with the control signal of the controller 14, and a display part 15 for displaying operation state of the selected menu.

The data input part 16 has a function key that acts to select the user's desired menu and to store the voltage output from the voltage dividing resistor 12 as the reference voltage after the input voltage is intentionally regulated to a rated voltage in a state that power is applied or a load is driven, in the memory 18 as a reference voltage. A nonvolatile memory (EEPROM) is used as the memory 18.

The operation of the apparatus for compensating cooking time of a microwave oven will be described below.

The input voltage to the input power part 11 is regulated to the rated voltage in a state that power is applied or a load is driven. The input voltage to the controller 14 through the voltage dividing resistor 12 is stored in the memory 18 using a specific key of the data input part 16.

The input power part 11 converts a commercial voltage to a low voltage to output a predetermined operation voltage. The voltage dividing resistor 12 includes a plurality of resistors R11 and R12 connected in parallel at both ports of the input power part 11 to output a divided voltage.

If the user selects a menu through the data input part 16, the controller 14 controls the load driver 17 in accordance with the selected menu to proceed with a cooking mode. The display part 15 displays cooking state. At this time, the controller 14 receives the voltage divided by the voltage dividing resistor 12 through an A/D port and compares the divided voltage with the reference voltage stored in the memory 18 so as to calculate cooking compensating time in accordance with the resultant value, thereby compensating cooking time.

The reference voltage data stored in the memory 18 is maintained without being erased even though the input power is cut off.

Figure 3:
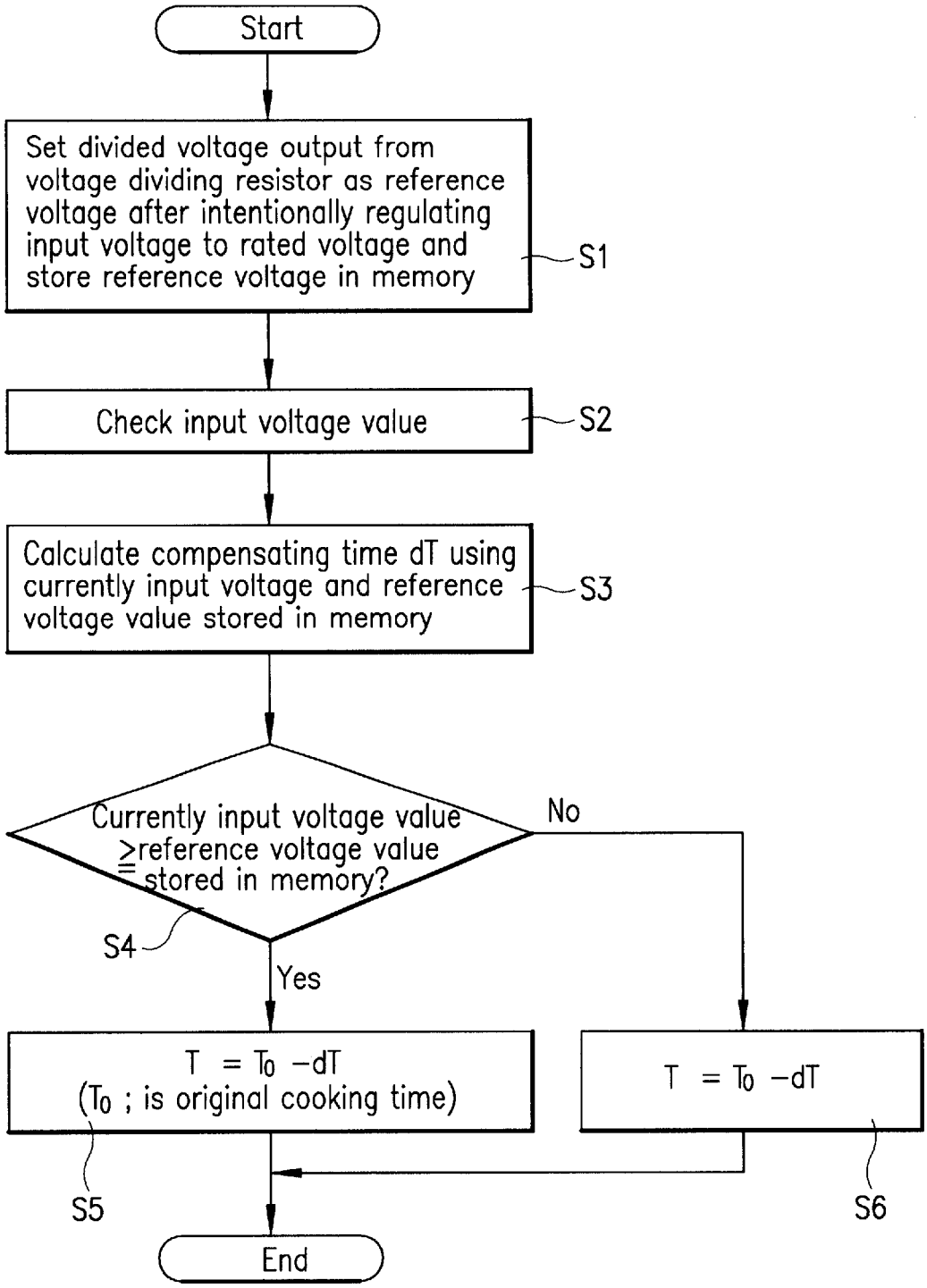
FIG. 3 is a flow chart showing a method for compensating cooking time of a microwave oven according to the present invention.

A method for compensating cooking time of a microwave oven according to the present invention will be described with reference to FIG. 3.

First, the input power to the input power part 11 is regulated to the rated voltage in a state that the power is applied or a load is driven. The input voltage to the controller 14 through the voltage dividing resistor 12 is stored in the memory 18 using a specific key of the data input part 16 (step S1).

The controller 14 checks a level of the voltage currently input through the voltage dividing resistor 12 (step S2). Subsequently, cooking compensating time dT is calculated using the checked input voltage data and the reference voltage data stored in the memory 18 (step S3). For example, it is assumed that the currently input voltage data is 115 and the reference voltage data stored in the memory is 120. In this case, a difference value between them is calculated as follows.

$$y=120-115=5 \qquad \text{[Equation 1]}$$

Subsequently, the difference value between them is applied to the following equation to obtain compensating time dT.

$$dT=y/r\times T_0$$

$$=5/120\times 300=12.5,$$

where, y is a difference value between the current input voltage data and the reference voltage store in the memory, r is a constant value, and $T_0$ is original cooking time.

If the compensating time dT is calculated as above, it is determined whether the currently input voltage value is greater than the reference voltage value (step S4).

Subsequently, as a result of the step S4, if the currently input voltage value is greater than the reference voltage value, the calculated compensating time dT is subtracted from the original cooking time $T_0$ to determine cooking time (step S5).

Meanwhile, as a result of the step S4, if the currently input voltage value is less than the reference voltage value, the calculated compensating time dT is added to the original cooking time $T_0$ to determine cooking time (step S6) .

Thus, the currently input voltage value is always compared with the reference voltage value to compensate cooking time.

As aforementioned, the apparatus and method for compensating cooking time of a microwave oven according to the present invention has the following advantages.

Since the reference voltage is set considering voltage variation at the output port of the input power part and deviation of the voltage dividing resistor, it is possible to exactly determine variation of the actual input voltage. Furthermore, variation of the actual input voltage is exactly determined to automatically control cooking time, thereby minimizing dissatisfaction of the user due to voltage variation.

It will be apparent to those skilled in the art that various modifications and variations can be made in the apparatus and method for compensating cooking time of a microwave oven according to the present invention without departing from the spirit or scope of the invention. Thus, it is intended that the present invention covers the modifications and variations of the invention provided they come within the scope of the appended claims and their equivalents.

What is claimed is:

1. An apparatus for compensating cooking time of a microwave oven, the apparatus comprising:

an input power part for converting a commercial power to a predetermined operation voltage;

a voltage dividing resistor for dividing the operation voltage;

a memory for storing a reference voltage, wherein the reference voltage is set equal to a reference divided operation voltage output by the voltage dividing resistor and determined under conditions in which the input voltage is intentionally regulated to a rated voltage in a state that power is applied or a load is driven; and a controller for comparing the reference voltage stored in the memory with the divided operation voltage output by the voltage dividing resistor to compensate cooking time in accordance with a difference value between them.

2. The apparatus as claimed in claim 1, wherein the memory is a nonvolatile memory.

3. The apparatus as claimed in claim 1, further comprising a data input part having a function key that acts to select a user's desired menu and to set and store the reference voltage in the memory.

4. The apparatus as claimed in claim 1, wherein the reference voltage is set while compensating voltage variations at an output terminal of the input power part and deviations of the voltage dividing resistor.

5. A method for compensating cooking time of a microwave oven having a memory, the method comprising:

setting a reference voltage to a divided operation voltage output by a measuring circuit under conditions where an input voltage is regulated to a rated voltage in a state that power is applied or a load is driven and storing the reference voltage in the memory;

checking a level of a currently input voltage; and calculating compensating time in accordance with a difference value between the currently input voltage and the reference voltage.

6. The method as claimed in claim 5, wherein the compensating time is calculated by dividing the difference value between the currently input voltage and the reference voltage by a constant value of a power voltage and multiplying the resultant value by original cooking time.

7. The method as claimed in claim 5, further comprising compensating cooking time by adding the calculated compensating time to original cooking time if the currently input voltage is less than the reference voltage value.

8. The method as claimed in claim 5, further comprising compensating cooking time by subtracting the calculated compensating time from original cooking time if the currently input voltage is greater than the reference voltage value.

9. The method as claimed in claim 5, wherein the divided operation voltage is output by a voltage dividing resistor connected to an output terminal that transmits the operation voltage, and wherein the reference voltage is set while compensating manufacturing variations in the voltage dividing resistor.

10. An apparatus for compensating cooking time of a microwave oven, the apparatus comprising:

an input power part for converting an input voltage to a predetermined operation voltage;

a measuring means for measuring the operation voltage and outputting a representative value;

a controller for comparing a reference voltage with a currently input voltage as determined by the representative value measured by the measuring means to compensate an original cooking time in accordance with a difference value between them; and a memory for storing the reference voltage, wherein the reference voltage is set equal to the representative value output by the measuring means when measuring the operation voltage under prescribed conditions where the input voltage is intentionally regulated to a rated voltage in a state that power is applied or a load is driven, and wherein the prescribed conditions compensate the reference value for individual element variations in the measuring means.

11. The apparatus of claim 10, wherein the measuring means is a voltage dividing resistor and the representative value is a divided operation voltage output by the voltage dividing resistor.

12. The apparatus of claim 11, wherein a compensating time dT is determined by the difference value according to $dT=y/r\times T_0$, and wherein y is the difference value between the currently input voltage and the reference voltage, r is a constant value, and $T_0$ is the original cooking time.

13. The apparatus of claim 10, further comprising:

a regulated power circuit part coupled to the input part for uniformly maintaining the operation voltage;

a data input part coupled to the controller for selecting user actions;

a load driver coupled to the controller for driving a load in accordance with a control signal from the controller; and a display part for displaying an operation state according to a selected menu.

* * * * *